US005435397A

United States Patent [19]

Demuth

[11] Patent Number: 5,435,397

[45] Date of Patent: Jul. 25, 1995

[54] ROTARY HAMMER WITH A PNEUMATIC HAMMER MECHANISM

[75] Inventor: Ulrich Demuth, Idstein, Germany

[73] Assignee: Black & Decker Inc., Newark, Del.

[21] Appl. No.: 155,733

[22] Filed: Nov. 22, 1993

[30] Foreign Application Priority Data

Nov. 23, 1992 [DE] Germany ..... 42 39 294.2

[51] Int. Cl.[6] ..... B25D 11/04

[52] U.S. Cl. ..... 173/109; 173/201; 173/48

[58] Field of Search ..... 173/109, 200, 201, 48

[56] References Cited

U.S. PATENT DOCUMENTS

| | | | |
|---|---|---|---|
| 3,835,935 | 9/1974 | Sides et al. . | |
| 4,280,359 | 7/1981 | Schmid et al. . | |
| 4,349,074 | 9/1982 | Ince . | |
| 4,442,906 | 4/1984 | Simpson | 173/201 |
| 4,567,951 | 2/1986 | Fehrle et al. | 173/201 |
| 4,611,670 | 9/1986 | Chromy | 173/201 |
| 4,719,976 | 1/1988 | Bleicher et al. | 173/201 |
| 4,750,567 | 6/1988 | Grossmann et al. . | |
| 5,111,890 | 5/1992 | Ranger et al. . | |

FOREIGN PATENT DOCUMENTS

| | | |
|---|---|---|
| 0014760 | 9/1980 | European Pat. Off. . |
| 0358978 | 3/1990 | European Pat. Off. . |
| 2641070 | 3/1978 | Germany . |
| 3316013 | 11/1984 | Germany . |
| 3629141 | 3/1988 | Germany . |
| 3743333 | 7/1989 | Germany . |
| 3804026 | 8/1989 | Germany . |
| 3931329 | 6/1990 | Germany . |
| 3932134 | 4/1991 | Germany . |
| 577368 | 5/1976 | Switzerland . |
| 663746 | 1/1988 | Switzerland . |

*Primary Examiner*—Scott A. Smith

*Attorney, Agent, or Firm*—Dennis A. Dearing; John D. Del Ponti; Charles E. Yocum

[57] ABSTRACT

A rotary hammer with a pneumatic hammer mechanism has a reciprocatable piston driven in a guide tube, which piston, through alternating development of overpressure and underpressure at its rear side, moves a ram forward to create an impact on the rear end of the bit and back again, the front side of the ram being connected to the surrounding air via at least one vent opening. The at least one vent opening is at least partially closeable to create a pressure countering the forward movement of the ram.

9 Claims, 3 Drawing Sheets

ROTARY HAMMER WITH A PNEUMATIC HAMMER MECHANISM

The invention relates to a rotary hammer with pneumatic hammer mechanism, which mechanism has a reciprocatable piston driven in a tubular casing, which piston, through alternating development of overpressure and underpressure at its rear side, moves a ram forward, to create an impact on the rear end of a bit and back again, the front side of the ram being connected to the surrounding air via at least one vent opening.

BACKGROUND TO THE INVENTION

Such rotary hammers are known in numerous forms (European Patent No. 0 014 760, U.S. Pat. No. 4,280,359, U.S. Pat. No. 4,750,567). In all these rotary hammers, a piston is moved to and fro driven coaxial to the rotation axis of a bit located in a tool holder of the rotary hammer in order to reciprocate a ram coaxial to the piston via the alternating development of overpressure and underpressure, by which ram the desired impacts are created on the rear end of the bit. The front side of the ram is connected to the surrounding air via at least one vent opening in order that, upon forward movement of the ram, air located in the space in front of the latter can be expelled without noteworthy resistance, so that the ram can strike with all of its available energy either the rear end of the bit or an anvil arranged between the rear end of the bit and the ram. This vent opening also ensures that, upon rearward movement of the ram, sufficient air can be sucked into the zone at the front side of the ram that no underpressure arises there which would reduce the rearward movement of the ram and thus the impact energy available during operation.

It is also already known (European Patent No. 0 358 978) to change the impact energy of a rotary hammer by changing the stroke of the driven reciprocatable piston. However, this requires a relatively complicated mechanism.

In U.S. Pat. No. 5,111,890 a rotary hammer is shown which comprises a tool body, a tubular casing in the tool body, a piston reciprocable in the casing and a ram reciprocable in the casing and adapted to impact a hammer bit, means for developing an alternating over and under pressure behind the ram to cause the ram to reciprocate and impact the bit and vent holes in the tubular casing which vent the air in front of the ram to the atmosphere. Associated with these vent holes are throttle holes, and the arrangement is such that, when the hammer is in an idle condition, the vent holes in front of the ram are closed, and the throttle holes are open, thus allowing for the creation of a slight overpressure in front of the ram to prevent the ram fully impacting the bit. When the hammer is in an operative, hammering condition, the vent holes in front of the ram are open and the throttle holes are closed, thus allowing the ram to impact the bit fully. Thus the arrangement does not allow for any variation of the force of impact of the ram on the bit when the hammer is in its operative, hammering, condition.

The object of the invention is to provide an improved rotary hammer in which a reduction in the impact energy transmitted from the ram onto the bit is easily effected.

SUMMARY OF THE INVENTION

The present invention provides a rotary hammer comprising a tool body, a tubular casing in the tool body, a piston reciprocable back and forwards in the casing, a ram reciprocable in the casing and adapted to impact a hammer bit, means for developing an alternating overpressure and under pressure behind the ram to cause the ram to reciprocate and impact the bit, at least one vent hole in front of the ram leading from inside the casing to vent air in front of the ram to atmosphere, and means for at least partially closing said at least one vent hole to create a pressure in the casing countering forward movement of the ram.

With a rotary hammer according to the invention it is thus possible, without changing the drive for the pneumatic hammer mechanism, to achieve a reduction in the impact energy to be transmitted onto the bit, by achieving in structurally simple manner a slowing of the forward movement of the ram through the development of a counter-pressure, the counter-pressure arising from the fact that the air located in the space in front of the forward-moving ram is no longer forced out unhindered through the at least one vent opening, but, because of the reduced size of the at least one vent opening, an overpressure results which increases as the cross-section of the vent opening is reduced. Because of the arising overpressure, the energy supplied by the drive for the hammer mechanism is thus partly destroyed, and the air compressed by the forward movement of the ram heats up. This heat can be easily removed, however, especially as operation with an at least partially covered vent opening is generally only a brief operation if, for example, the very brittle surface of a wall-or floor-tile is initially to be pierced with a relatively low impact energy. As soon as the surface is punctured by the bit, the at least one vent opening can then be completely cleared again and the bit impinged upon by the maximum impact energy.

In a preferred version of the rotary hammer, the piston of the hammer mechanism is a hollow piston housing the ram, and the at least one vent opening is provided in a tubular casing for the piston. The tool preferably comprises means for rotating the tubular casing.

If the tubular casing is axially movable to the rear against spring pressure through engagement of the bit with the workpiece to be treated, as is the case for example with the rotary hammer according to U.S. Pat. No. 4,750,567, the rearmost position of the tubular casing can be adjusted, and a stationary annular element enclosing the tubular casing may be provided adjacent the at least one vent opening, which annular element, upon displacement of the tool spindle into its maximum possible rear end-position, is in front of the at least one vent opening and, in a rear end-position of the tool spindle lying in front of the maximum possible rear end-position, at least partly covers the at least one vent opening. The annular element can simultaneously form a bearing for the tubular casing.

With such a rotary hammer the user can thus, by adjusting the rearmost end position of the tubular casing, reduce the impact energy which the ram transmits onto the bit engaging with the workpiece.

In another version of a rotary hammer according to the invention, an axially movable adjusting ring arranged on the outer surface of the tubular casing can be provided to at least partly cover the at least one vent opening. The axial position of the adjusting ring can be adjusted by the user, for example with the help of a control ring, enclosing the front section of the rotary hammer housing, which is coupled with the adjusting ring by pins extending through helical slots in the hammer housing.

The invention will be described in more detail below with reference to the figures which show two rotary hammers embodying the invention.

DETAILED DESCRIPTION OF THE INVENTION

Figure 1:
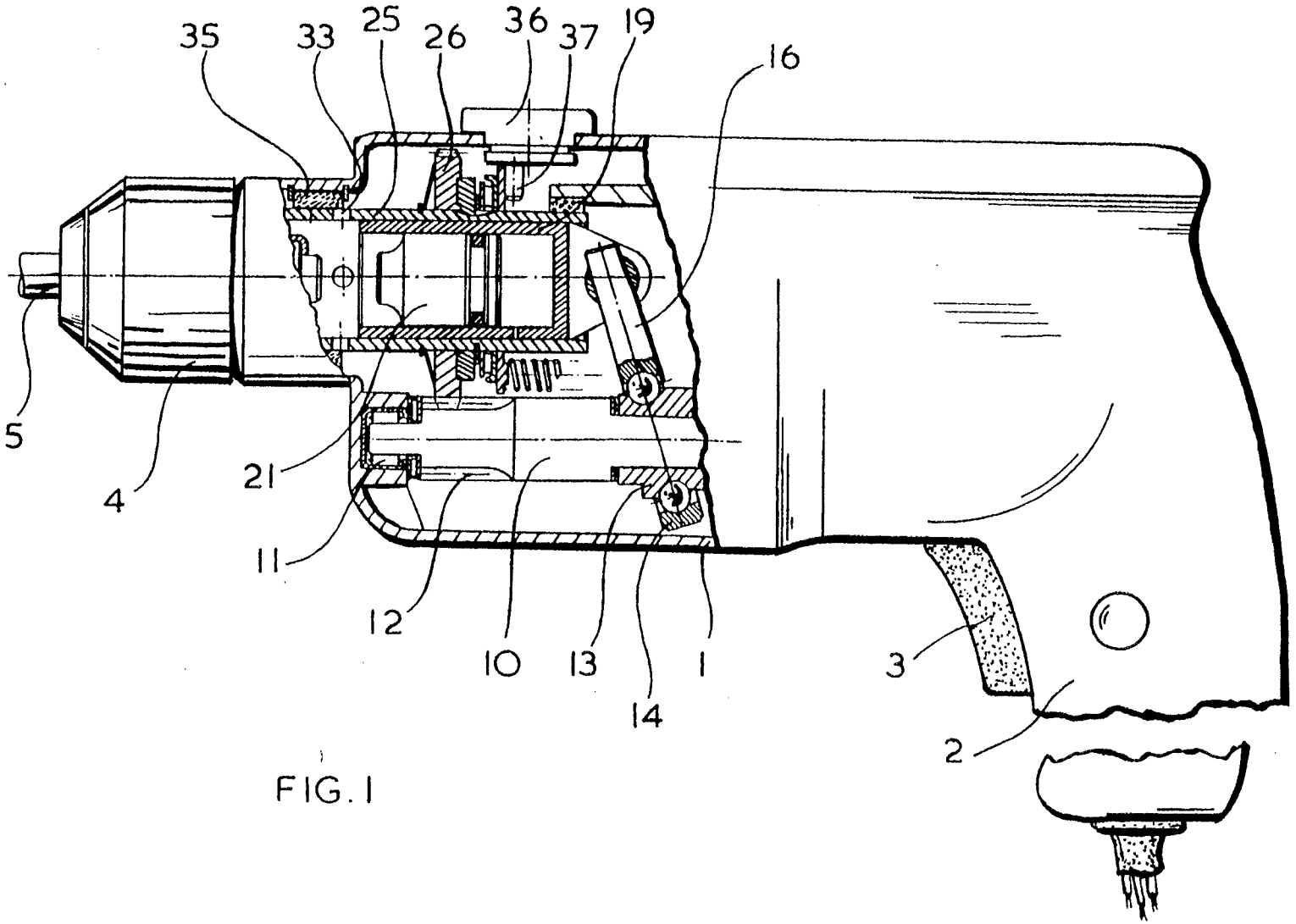
FIG. 1 shows a rotary hammer in side view, partly broken open and partly in section.
Figure 2:
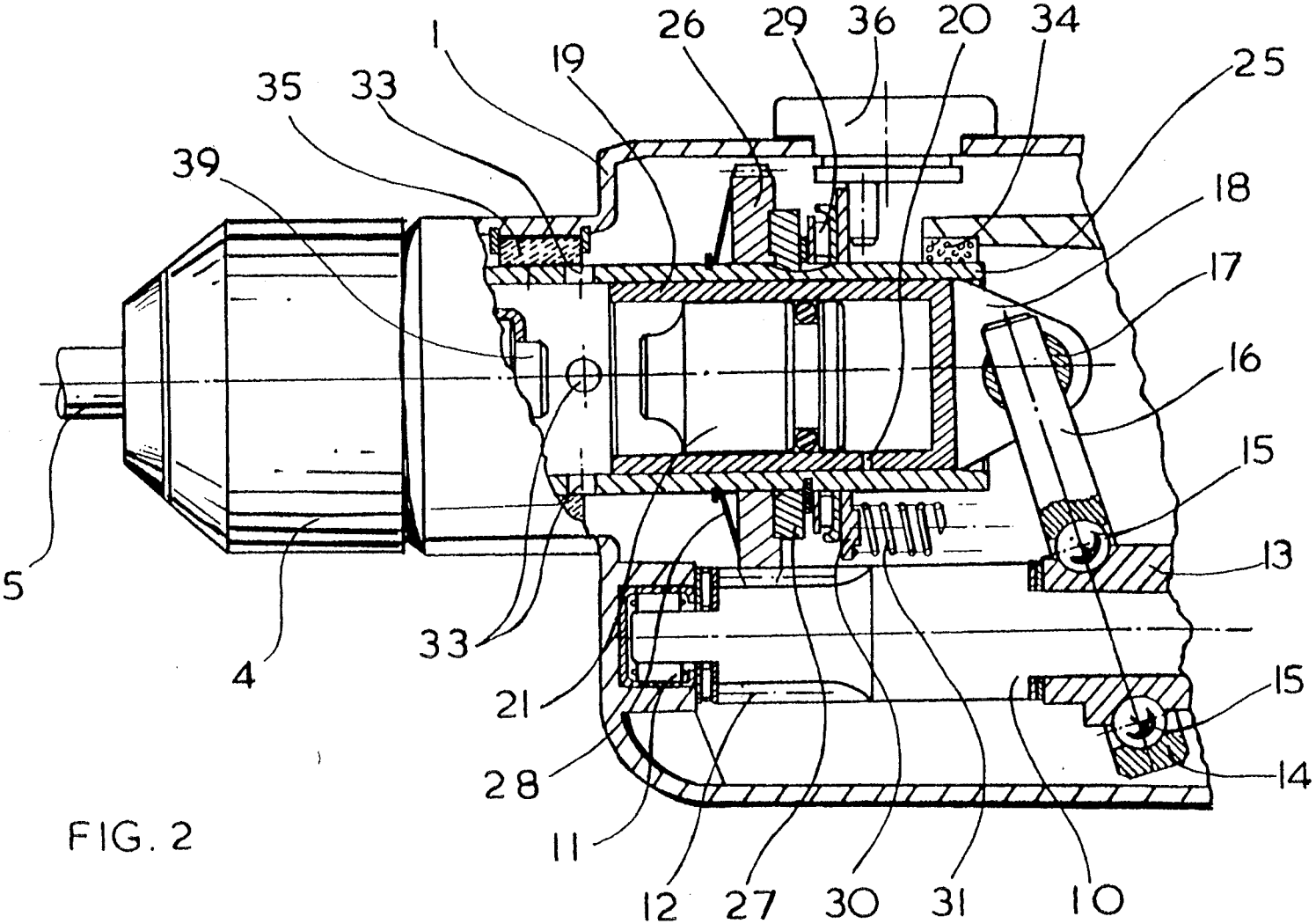
FIG. 2 shows, magnified, the front section of the rotary hammer from FIG. 1.

The rotary hammer represented in FIGS. 1 and 2 has a housing 1 made up in the usual way of half-shells with a pistol grip 2 from which projects a trigger 3 for the activation of the on/off switch, which is not shown. At the front end of the rotary hammer facing away from pistol grip 2 a conventional tool holder 4 is provided in which a partly represented bit 5 is located. The rotary hammer represented has an electric motor, not shown, arranged in the usual manner in the pistol grip 2, which motor drives an intermediate shaft 10 in rotary manner via a gear arrangement, also not shown, which shaft 10 is rotatably housed with its front end in a bearing 11 secured in the housing 1. Formed on a front end portion of the intermediate shaft 10 is a toothed-wheel section 12 which meshes with a toothed wheel 26 secured non-rotatably on a casing 25 by means of a washer 27 fixed on the casing 25, a plate spring 28, likewise arranged around the casing 25, pressing the toothed wheel 26 against the washer 27. The casing 25 is supported in two bearings 34, 35 and, upon rotation of the intermediate shaft 10, is rotated via the meshing engagement of toothed-wheel section 12 and toothed wheel 26 so that it rotates the tool holder 4 and thus the bit 5 in the usual way.

Guided axially reciprocally in the casing 25 is a hollow piston 19 which has at its rear, closed, end projections 18 through which a rotatable pin 17 extends transversely. Seated on the intermediate shaft 10 is a wobble plate arrangement comprising hub element 13, bearing ring 14, bearing balls 15 arranged between hub element 13 and bearing ring 14 and a wobble pin 16 extending from the bearing ring 14. The wobble pin 16 extends into a cross-bore of the pin 17 and is axially displaceable in the latter. Such a drive is described for example in U.S. Pat. No. 4,280,359.

Located in the hollow piston 19 is an axially reciprocatable ram 21 which lies in sealing manner with an 0-ring against the inner wall of the hollow piston 19 and which, upon reciprocal movement generated by the wobble plate drive 13, 14, 15, 16, is moved to and fro, for example in the manner described in European Pat. No. 0 014 760, for over-pressure and an underpressure being developed alternately in the space between the end wall of the hollow piston 19 and the rear surface of the ram 21 through the interaction of the cross-bore 20 provided in the wall of the hollow piston 19 and the four vent openings 33 provided in the wall of the casing 25 and distributed at the circumference, so that the ram 21 is moved forward in impact operation in order to strike an anvil 39, which transmits this impact onto the rear end of the hammer bit 5, while subsequent underpressure sucks the ram 21 back towards the end wall of the hollow piston 19; overpressure is then again developed in the space between the end wall of the hollow piston 19 and the rear surface of the ram 21.

When the bit is not placed against a workpiece, the casing 21 is located, as a result of pressure from the spring 31, in a forward position, not shown, in which the vent openings 33 are fully covered by the annular bearing 35. If the hollow piston 19 is reciprocated in this position, an overpressure develops with every forward movement of the ram 21 in front of the latter, which stops the ram 19 from transmitting impacts onto the anvil 39 and thus onto the rear end of the bit 5.

If the casing 25 is moved axially rearward by contact pressure of the bit 5 against the workpiece, the vent openings 33 which lie in front of the hollow piston located in its forward position (FIGS. 1 and 2) are moved out of the area of the annular bearing 35 and opened. This means that upon forward movement of the ram 21, the air present in the casing 25 between ram 21 on the one hand and anvil 39 and guide for the latter on the other hand can therefore vent through the openings 33 so that no pressure countering forward movement of the ram 21 is developed. Equally air can enter through the vent openings 33 when ram 21 moves rearwardly in the hollow piston 19, so that no underpressure adversely affecting the movement of the ram 21 to the rear is developed in the area in front of the ram 21.

Seated on the casing 25 adjacent to the washer 27 is a needle bearing 29 on the side of which facing away from the washer 27 a support disc 30 is secured. The support disc 30 and the adjacent race of the bearing 29 are held unrotatably in the housing and are thus arranged freely rotatably on the casing 25. Lying against the support disc 30 are the springs 31 which load the casing 25 in forward direction, so that, when the bit 5 is not engaged with the workpiece, the casing 25 and the parts connected to it are in the forward position (not shown). If the bit 5 is pressed against the workpiece when the intermediate shaft 10 is rotated and the tool holder 4 is thus rotating, the casing 25 is moved against the force of the springs 31 into the position shown in FIGS. 1 and 2, in which the support disc 30 lies against an eccentric pin 37 of an adjusting knob 36 secured rotatably in housing 1.

As shown in FIGS. 1 and 2, the eccentric pin 37 is in its forward position. If the pin 37 is moved, by rotation of the knob 36 through 180°, into its rear position, this is then the maximum possible rear end-position for the casing 25 when the bit 5 engages a workpiece. In this maximum possible rear end-position, the vent openings 33 of the casing 25 are in a position which has been moved to the right compared with FIGS. 1 and 2 and are thus held at a distance from the annular bearing 35 which is fixed in the housing 1. The vent openings 33 are fully opened in this position and can let the air leave upon forward movement of the ram 21 and let the air enter upon rearward movement of the ram 21, so as not to impair the movement of the ram 21 through the development of overpressure or underpressure at its front side.

While the ram 21 transmits the maximum impact energy in the operating case explained above, it may be desired to impinge upon the bit 5 with less impact energy, say in order to drill through sensitive workpiece surfaces without breaking them. To this end, the user can rotate the adjusting knob 36 so that the eccentric pin 37 comes into a position lying further forward, i.e. for example into the position according to FIGS. 1 and 2. In this way an end-position for the rearward movement of the casing 25 is defined which lies in front of the maximum possible rear end-position. As can be seen in FIGS. 1 and 2, the vent openings 33 are in the region of the annular bearing 35 in this rear end-position which lies further forward, and are partly covered by said bearing. Therefore, if the ram 21 is moved forward, the air located in the space between the front side of ram 21 and the rear zone of the anvil 39 and its holding system can no longer emerge unimpaired from this space through the vent openings 33, but there develops, because of the reduced cross-section of the vent openings 33, a certain overpressure which somewhat slows down the forward movement of the ram 21 and thus allows the ram 21 to exert an impact on the bit 5 with reduced energy. The degree of the reduction in the impact energy naturally depends on the extent to which the through-passage cross-sections of the vent openings 33 are reduced, and a virtually complete covering of the vent openings 33 can take place where appropriate. The user can choose the covering of the vent openings 33, and thus the reduction in impact energy, through appropriate adjustment of the setting knob 36 and thus of the eccentric pin 37.

Figure 3:
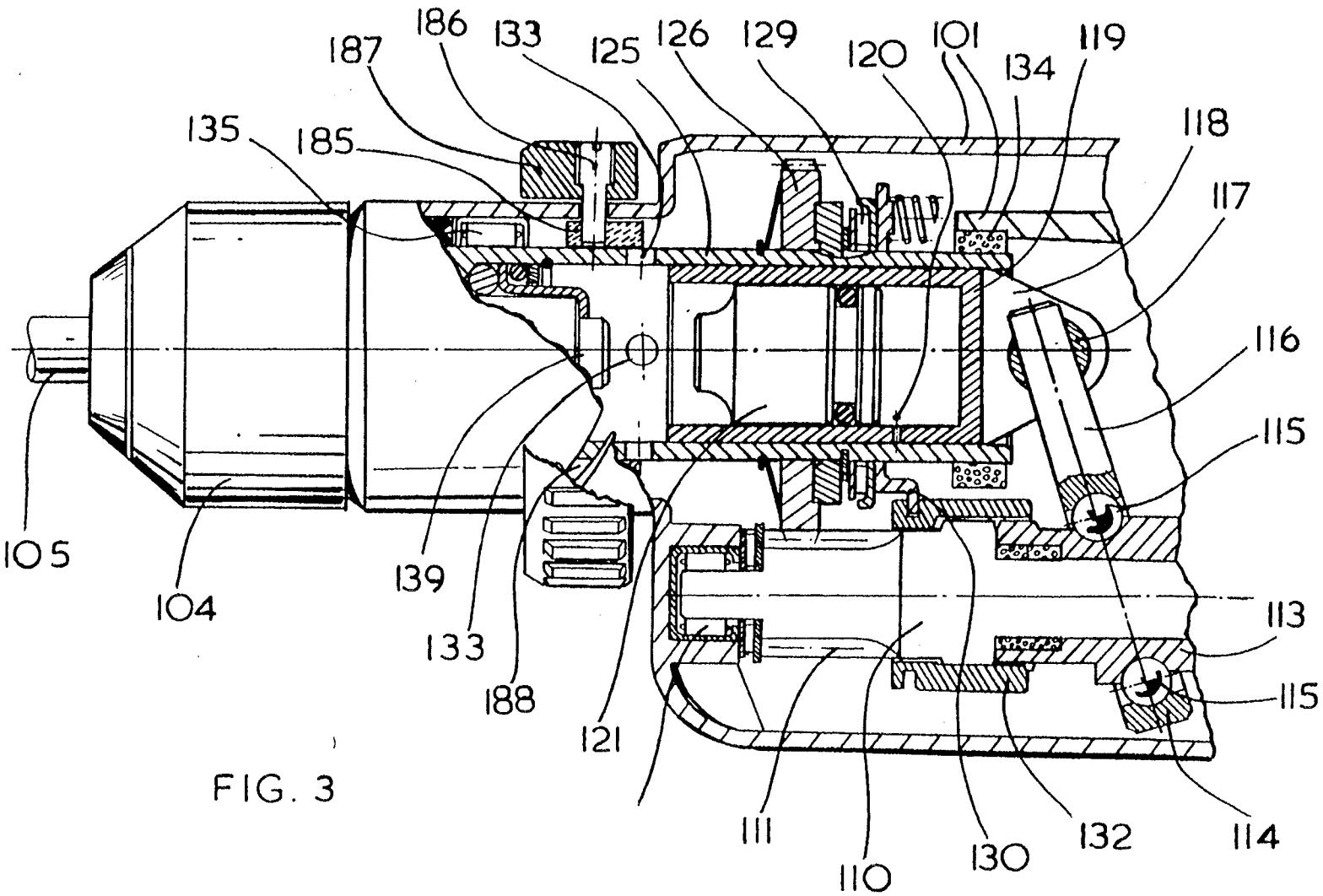
FIG. 3 shows, in a representation corresponding to FIG. 2, another embodiment of the rotary hammer.

The rotary hammer represented in FIG. 3 corresponds in terms of its basic structure to the one from FIGS. 1 and 2, and parts identical to those in the rotary hammer according to FIGS. 1 and 2 have the same reference numerals, only increased by 100. In some cases, these parts are not described again. It should, however, be pointed out that the representation of the rotary hammer according to FIG. 3 has been somewhat simplified, through the omission of components, for the purposes of clarity compared with those from FIGS. 1 and 2.

The casing 125 of the rotary hammer shown in FIG. 3 is displaceable through engagement of the bit with the workpiece into an axial end-position which is represented in FIG. 3. The casing 125 sits rotatably in annular bearings 134 and 135 in order, upon rotary drive through the intermediate shaft 110, to drive the tool holder 104, and thus the bit 105 held in the latter, in rotary manner.

Upon displacement of the casing 125 into the end-position shown in FIG. 3, the support disc 130 is moved accordingly and displaces a claw ring 132 arranged on the intermediate shaft 110 into coupling engagement with the hub element 113, so that the intermediate shaft drives the latter and thus the drive for the hollow piston 119.

The vent openings 133 in the casing 125 lie, as in the case of the rotary hammer of FIGS. 1 and 2, in front of the hollow piston 119 in its shown forward position. Seated on the outside of the casing 125 freely rotatably relative to the latter is an adjusting ring 185 which is connected, via pins 186 which are guided in the housing 101 in helically shaped grooves 188, to a control ring 187 enclosing the front section, i.e., the neck of the housing 101. Through rotation of the control ring 187 and the resultant movement of the pins 186 along the grooves 188, the adjusting ring 185 can be moved axially to and fro between a rear position which corresponds to that shown in FIG. 3 and a front position which is not shown. In the front position, the adjusting ring 185 is located outside the zone of the vent openings 133, so that their cross-sections lie completely free, i.e. air can leave and enter unhindered from the space between ram 121 and anvil 139 including its holding means. There is thus no impairment of the reciprocating movement of the ram 121. If the user wishes to reduce the impact energy to be applied, he rotates the control ring 187 in order to bring the adjusting ring 185 into a position in which it covers the vent openings 133 to the desired extent, i.e. reduces their through-passage cross-sections. The result, as already described in connection with FIGS. 1 and 2, upon forward movement of the ram 121, is an overpressure in the space in front of the ram 121 which leads to a slowing down of the ram 121 and thus a reduction in the impact energy to be transmitted onto the bit 105.

I claim:

1. A rotary hammer having an idle mode and a hammer mode and comprising:

a tool body;

a tubular casing in the tool body;

a piston comprising a forward end and reciprocable back and forwards in the casing;

a ram reciprocable in the casing and adapted to impact a hammer bit;

means for developing an alternating over pressure and under pressure behind the ram to cause the ram to reciprocate and impact the bit;

at least one vent hole in front of the ram leading from inside the casing to vent air in front of the ram to atmosphere; and means for selectively fully opening and at least partially closing said at least one vent hole in the hammer mode to create a pressure in the casing countering forward movement of the ram.

2. A rotary hammer according to claim 1 wherein the piston is hollow and open at the forward end; and the ram is mounted for reciprocating movement in the piston.

3. A rotary hammer according to claim 1 comprising means for rotating said tubular casing.

4. A rotary hammer according to claim 3:

wherein the tubular casing is mounted for axial movement in the tool body;

further comprising a spring means for urging the tubular casing forwardly; and wherein the opening and closing means comprises:

(a) an adjustable stop determining the rearmost position of the tubular casing when the casing is moved rearwardly against the spring means by engagement of the hammer bit with a workpiece; and (b) an annular element fixed in the tool body surrounding the casing adjacent to the at least one vent hole, which element is so positioned that if the casing is moved rearwardly the maximum amount allowed by adjustment of the stop, the annular element is forward of the at least one vent hole, while if the casing is moved rearwardly the minimum amount allowed by adjustment of the stop the annular element at least partly covers the at least one vent hole.

5. A rotary hammer according to claim 4 wherein the annular element is an annular bearing for the tubular casing.

6. A rotary hammer according to claim 3 wherein:

the opening and closing means comprises an adjusting ring mounted on the tubular casing and movable axially of the casing to cover the at least one vent hole.

7. A rotary hammer according to claim 6 wherein the opening and closing means further comprises:

a control ring mounted on the tool body, and pins extending through helical grooves in the tool body and interconnecting the control ring with the adjusting ring whereby rotation of the control ring causes axial movement of the adjusting ring.

8. A rotary hammer having an idle mode and a hammer mode and comprising:

a tool body;

a tubular casing the tool body;

a piston reciprocable back and forwards in the casing;

a ram reciprocable in the casing and adapted to impact a hammer bit;

means for developing an alternating over pressure and under pressure behind the ram to cause the ram to reciprocate and impact the bit;

at least one vent hole in front of the ram leading from inside the casing to vent air in front of the ram atmosphere; and means for selectively (a) fully opening the vent hole in the hammer mode and (b) at least partially closing the vent hole to create a pressure in the casing countering forward movement of the ram.

9. A rotary hammer having an idle mode and a hammer mode and comprising:

a tool body;

a tubular casing the tool body;

a piston reciprocable back and forwards in the casing;

a ram reciprocable in the casing and adapted to impact a hammer bit;

means for developing an alternating over pressure and under pressure behind the ram to cause the ram to reciprocate and impact the bit;

at least one vent hole in front of the ram leading from inside the casing to vent air in front of the ram atmosphere; and means for manually adjusting the size of the vent hole for varying the maximum impact energy of the ram on the hammer bit in the hammer mode.

* * * * *